US012104352B2

(12) United States Patent
Fujiwara et al.

(10) Patent No.: US 12,104,352 B2
(45) Date of Patent: Oct. 1, 2024

(54) COMPACTION MANAGEMENT SYSTEM

(71) Applicant: KOBELCO CONSTRUCTION MACHINERY CO., LTD., Hiroshima (JP)

(72) Inventors: Sho Fujiwara, Hiroshima (JP); Yusuke Kamimura, Hiroshima (JP); Yoichiro Yamazaki, Hiroshima (JP); Koji Yamashita, Hiroshima (JP); Daisuke Noda, Hiroshima (JP); Hideki Yoshihara, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 622 days.

(21) Appl. No.: 17/435,231

(22) PCT Filed: Mar. 12, 2020

(86) PCT No.: PCT/JP2020/010796
§ 371 (c)(1),
(2) Date: Aug. 31, 2021

(87) PCT Pub. No.: WO2020/189494
PCT Pub. Date: Sep. 24, 2020

(65) Prior Publication Data

US 2022/0145584 A1 May 12, 2022

(30) Foreign Application Priority Data

Mar. 19, 2019 (JP) ..... 2019-050739

(51) Int. Cl.
*E02F 9/20* (2006.01)
*E02F 3/43* (2006.01)
(Continued)

(52) U.S. Cl.
CPC ..... *E02F 3/967* (2013.01); *E02F 3/437* (2013.01); *E02F 9/264* (2013.01)

(58) Field of Classification Search
CPC . E02F 3/435; E02F 3/437; E02F 3/967; E02F 9/264; E02F 9/265; E01C 19/288; E01C 19/25; E01C 19/266
See application file for complete search history.

(56) References Cited

U.S. PATENT DOCUMENTS 5,826,666 A 10/1998 Tozawa et al.
9,938,694 B2 * 4/2018 Matsuyama ..... E02F 9/2292
(Continued)

FOREIGN PATENT DOCUMENTS

JP 9-228404 A 9/1997
JP 3460224 B2 10/2003
(Continued)

OTHER PUBLICATIONS

Extended European Search Report issued Apr. 13, 2022, in European Patent Application No. 20773053.2, 6 pages.
(Continued)

*Primary Examiner* — Thomas B Will
*Assistant Examiner* — Robert E Pezzuto
(74) *Attorney, Agent, or Firm* — Oblon, McClelland, Maier & Neustadt, L.L.P.

(57) ABSTRACT

A compaction management system includes a position calculation unit that, when a bucket is pressed against a compaction target ground, calculates a position of the bucket, a rolling compaction force calculation unit that, when the bucket is pressed against the compaction target ground, calculates a rolling compaction force applied to the compaction target ground using the attitude of the machine body, the attitude of the attachment, a pressure of a cylinder, and dimensions of the attachment, a rolling compaction
(Continued)

record creation unit that creates a rolling compaction record in which the position calculated by the position calculation unit is associated with the rolling compaction force calculated by the rolling compaction force calculation unit, and a storage control unit that causes a storage device to store the rolling compaction record created by the rolling compaction record creation unit.

11 Claims, 5 Drawing Sheets

(51) Int. Cl.
*E02F 3/96* (2006.01)
*E02F 9/26* (2006.01)

(56) References Cited

U.S. PATENT DOCUMENTS

| | | | | |
|---|---|---|---|---|
| 2014/0200776 | A1* | 7/2014 | Matsuyama ..... | E02F 9/264 701/50 |
| 2016/0103051 | A1 | 4/2016 | Corcoran et al. | |
| 2018/0179719 | A1 | 6/2018 | Wisley et al. | |

FOREIGN PATENT DOCUMENTS

| | | | |
|---|---|---|---|
| JP | 2010-84383 | A | 4/2010 |
| JP | 2012-26113 | A | 2/2012 |
| JP | 2013-209843 | A | 10/2013 |

OTHER PUBLICATIONS

International Search Report mailed on May 26, 2020 in PCT/JP2020/010796 filed on Mar. 12, 2020 (2 pages).

* cited by examiner

COMPACTION MANAGEMENT SYSTEM

TECHNICAL FIELD

The present invention relates to a compaction management system that manages a compaction state of a compaction target ground.

BACKGROUND ART

Patent Literature 1 discloses that a top of slope on an embankment is compacted by a work machine including a rolling compaction device, and a compaction time is integrated for each place to be compacted, thereby quantitatively managing a compaction state of the top of slope using the compaction time.

The compaction state of the place can be estimated from the compaction time, but a rolling compaction force applied to the place cannot be accurately managed. Therefore, the compaction state of a compaction target ground cannot be accurately managed.

CITATION LIST

Patent Literature

Patent Literature 1: JP 2012-26113 A

SUMMARY OF INVENTION

An object of the present invention is to provide a compaction management system capable of accurately managing a compaction state of a compaction target ground.

A compaction management system according to an aspect of the present invention includes: a work machine including; a machine body, a work device attached to the machine body rotatably and vertically, a rotary device capable of hydraulically rotating the work device, a machine body attitude detection device that detects an attitude of the machine body, a work device attitude detection device that detects an attitude of the work device, a position detection device that detects a position of the machine body, an orientation detection device that detects an orientation of the machine body, a pressure detection device that detects a pressure of the rotary device, and a dimension storage device that stores dimensions of the work device; a position calculation unit that, when the work device is pressed against a compaction target ground, calculates a rolling compaction position which is a pressing position of the work device against the compaction target ground using the attitude of the machine body detected by the machine body attitude detection device, the attitude of the work device detected by the work device attitude detection device, the position of the machine body detected by the position detection device, and the orientation of the machine body detected by the orientation detection device; a rolling compaction force calculation unit that, when the work device is pressed against the compaction target ground, calculates a rolling compaction force applied to the compaction target ground using the attitude of the machine body detected by the machine body attitude detection device, the attitude of the work device detected by the work device attitude detection device, the pressure detected by the pressure detection device, and the dimensions of the work device stored in the dimension storage device; a rolling compaction record creation unit that creates a rolling compaction record in which the position calculated by the position calculation unit is associated with the rolling compaction force calculated by the rolling compaction force calculation unit; a storage device; and a storage control unit that causes the storage device to store the rolling compaction record created by the rolling compaction record creation unit.

DESCRIPTION OF EMBODIMENT

Hereinafter, preferred embodiment of the present invention will be described with reference to the drawings.

Configuration of Work Machine

A compaction management system according to an embodiment of the present invention manages a compaction state of a compaction target ground. The compaction management system includes a work machine.

Figure 1:
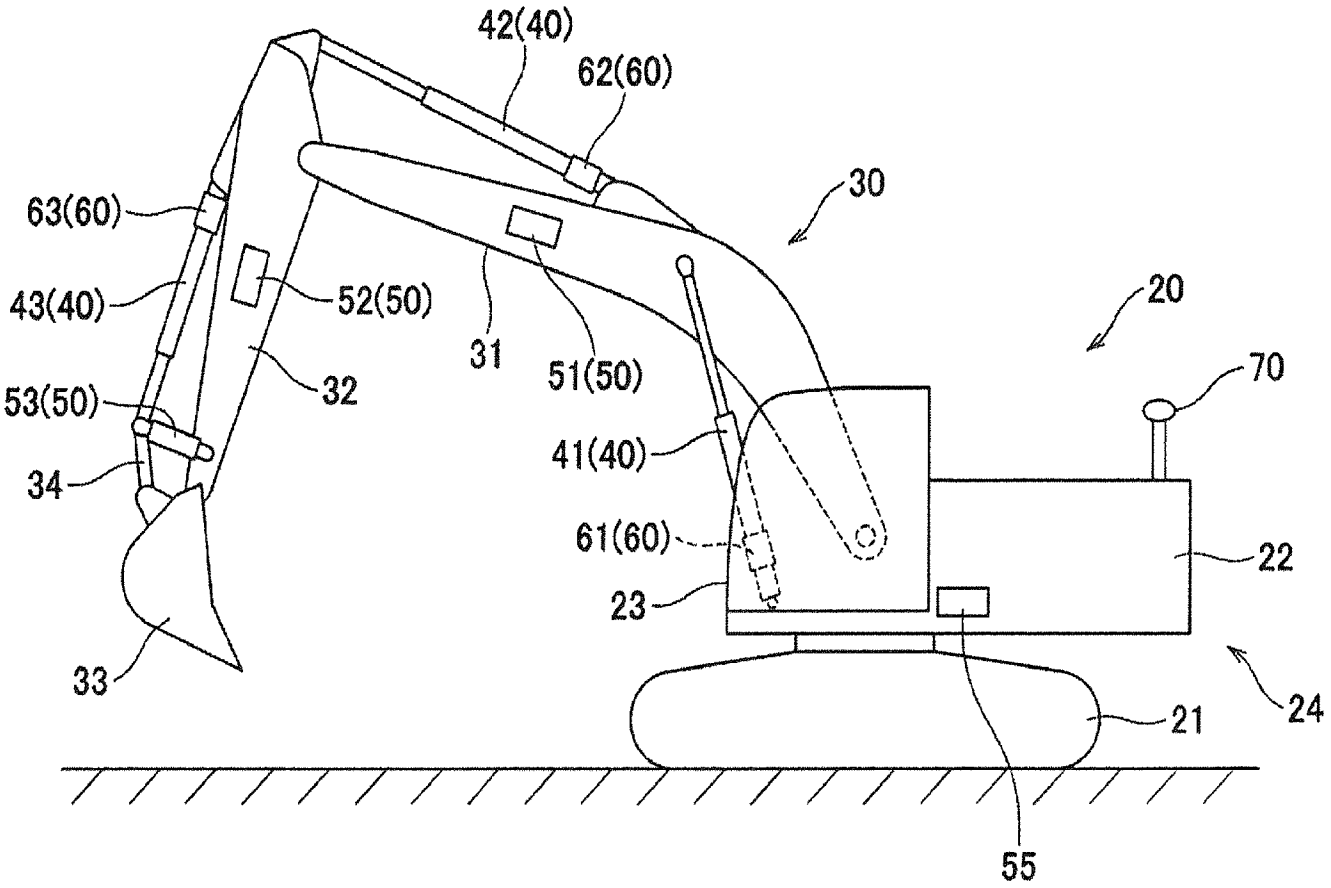
FIG. 1 is a side view of a work machine.

As illustrated in FIG. 1 which is a side view of a work machine 20, the work machine 20 is a machine, such as a hydraulic excavator, that performs work using an attachment 30. The work machine 20 includes a machine body 24 having a lower travelling body 21 and an upper slewing body 22, the attachment 30, and a cylinder 40.

The lower travelling body 21 is a portion that causes the work machine 20 to travel, and includes, for example, crawlers. The upper slewing body 22 is rotatably attached to an upper portion of the lower travelling body 21 via a slewing device. A cab (operator's cab) 23 is provided in a front portion of the upper slewing body 22.

The attachment (work device) 30 is attached to the upper slewing body 22 rotatably and vertically. The attachment 30 includes a boom 31, an arm 32, and a bucket 33. The boom 31 is rotatably (raisably) attached to the upper slewing body 22. The arm 32 is rotatably attached to the boom 31. The bucket 33 is rotatably attached to the arm 32. The bucket 33 performs work such as excavation, leveling, and scooping of a work target (earth and sand).

The cylinder (rotary device) 40 can hydraulically rotate the attachment 30. The cylinder 40 is a hydraulic telescopic cylinder. The cylinder 40 includes a boom cylinder 41, an arm cylinder 42, and a bucket cylinder 43.

The boom cylinder 41 rotationally drives the boom 31 with respect to the upper stewing body 22. A proximal end of the boom cylinder 41 is rotatably attached to the upper slewing body 22. A distal end of the boom cylinder 41 is rotatably attached to the boom 31.

The arm cylinder 42 rotationally drives the arm 32 with respect to the boom 31. A proximal end of the arm cylinder 42 is rotatably attached to the boom 31. A distal end of the arm cylinder 42 is rotatably attached to the arm 32.

The bucket cylinder 43 rotationally drives the bucket 33 with respect to the arm 32. A proximal end of the bucket cylinder 43 is rotatably attached to the arm 32. A distal end of the bucket cylinder 43 is rotatably attached to a link member 34 rotatably attached to the bucket 33.

The work machine 20 further includes an inclination angle sensor 50, a main body inclination angle sensor 55, a pressure sensor 60, and a global navigation satellite system (GNSS) device 70.

The inclination angle sensor (work device attitude detection device) 50 detects an attitude of the attachment 30. The inclination angle sensor 50 includes a boom inclination angle sensor 51, an arm inclination angle sensor 52, and a bucket inclination angle sensor 53.

The boom inclination angle sensor 51 is attached to the boom 31 and detects an attitude of the boom 31. The boom inclination angle sensor 51 is, for example, an inclination (acceleration) sensor that acquires an inclination angle of the boom 31 with respect to a horizontal line. Note that the boom inclination angle sensor 51 may be a rotation angle sensor that detects a rotation angle of a boom foot pin (boom proximal end) or a stroke sensor that detects a stroke amount of the boom cylinder 41. The horizontal line is, for example, parallel to a ground.

The arm inclination angle sensor 52 is attached to the arm 32 and detects an attitude of the arm 32. The arm inclination angle sensor 52 is, for example, an inclination (acceleration) sensor that acquires an inclination angle of the arm 32 with respect to the horizontal line. Note that the arm inclination angle sensor 52 may be a rotation angle sensor that detects a rotation angle of an arm connecting pin (arm proximal end) or a stroke sensor that detects a stroke amount of the arm cylinder 42.

The bucket inclination angle sensor 53 is attached to the link member 34 and detects an attitude of the bucket 33. The bucket inclination angle sensor 53 is, for example, an inclination (acceleration) sensor that acquires an inclination angle of the bucket 33 with respect to the horizontal line. The bucket inclination angle sensor 53 may be a rotation angle sensor that detects a rotation angle of a bucket connecting pin (bucket proximal end) or a stroke sensor that detects a stroke amount of the bucket cylinder 43.

The main body inclination angle sensor (machine body attitude detection device) 55 is attached to the upper slewing body 22 and detects an attitude of the machine body 24. The main body inclination angle sensor 55 is, for example, a biaxial inclination (acceleration) sensor that acquires an inclination angle of the machine body 24 with respect to a horizontal plane.

The pressure sensor (pressure detection device) 60 detects a pressure of the cylinder 40. The pressure sensor 60 includes a boom cylinder pressure sensor 61, an arm cylinder pressure sensor 62, and a bucket cylinder pressure sensor 63.

The boom cylinder pressure sensor 61 is attached to the boom cylinder 41 and detects a pressure on a head side and a pressure on a rod side of the boom cylinder 41. The arm cylinder pressure sensor 62 is attached to the arm cylinder 42 and detects a pressure on a head side and a pressure on a rod side of the arm cylinder 42. The bucket cylinder pressure sensor 63 is attached to the bucket cylinder 43 and detects a pressure on a head side and a pressure on a rod side of the bucket cylinder 43.

At least two GNSS devices (position detection device and orientation detection device) 70 are disposed in the machine body 24. The GNSS devices 70 are attached to the upper slewing body 22 to be separated from each other. The individual GNSS device 70 receives a signal transmitted from a global positioning satellite system (GNSS). The GNSS devices 70 each detect a time at which a signal is transmitted, based on the received signal, and detects the position of the machine body 24 using a radio wave speed and a radio wave transmission time (a difference between the transmission time and an arrival time). In addition, the GNSS devices 70 each detect an orientation of the upper slewing body 22, i.e. an orientation of the attachment 30 based on a deviation of the signals received by the individual GNSS devices 70.

Figure 2:
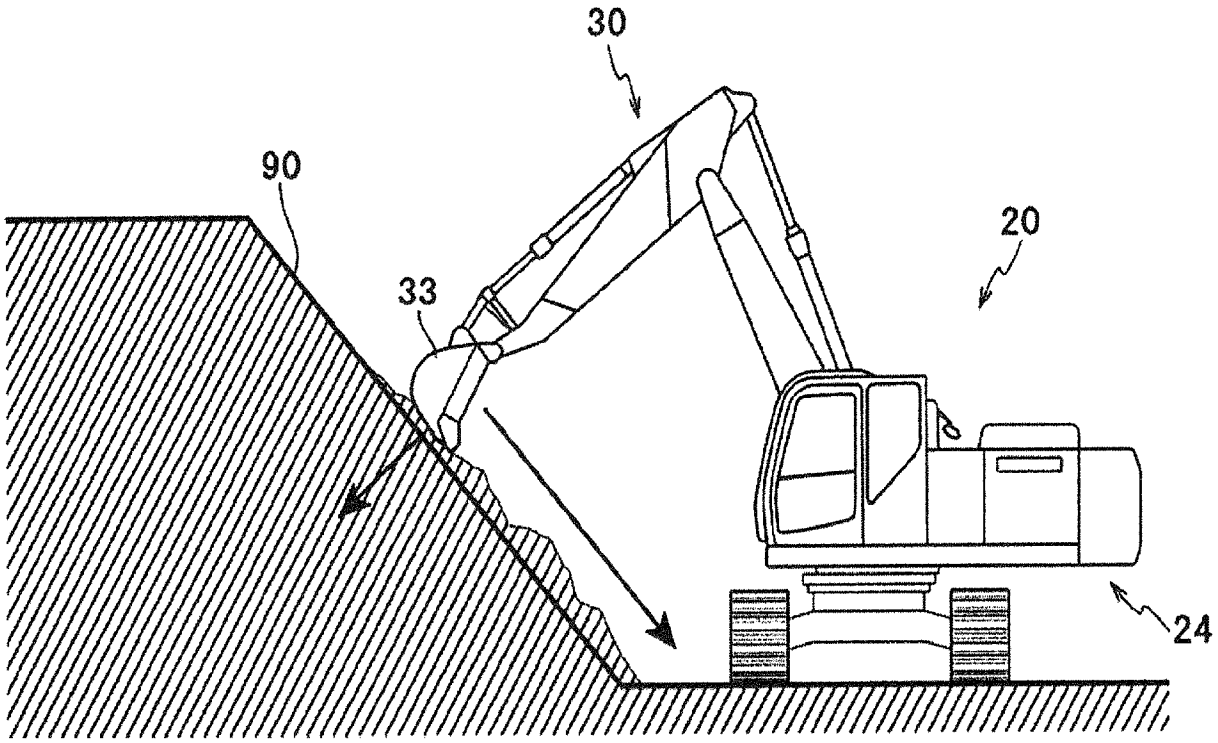
FIG. 2 is a side view illustrating the work machine in operation.

FIG. 2 is a side view illustrating the work machine 20 in operation. As illustrated in FIG. 2, the work machine 20 performs work of leveling a compaction target ground 90 with the bucket 33. In addition, the work machine 20 performs work of compacting the compaction target ground 90. During the work of compacting the compaction target ground 90, a bottom surface of the bucket 33 is pressed against the compaction target ground 90. As a result, a rolling compaction force is applied to the place of the compaction target ground 90 where the bucket 33 is pressed.

Configuration of Compaction Management System

Figure 3:
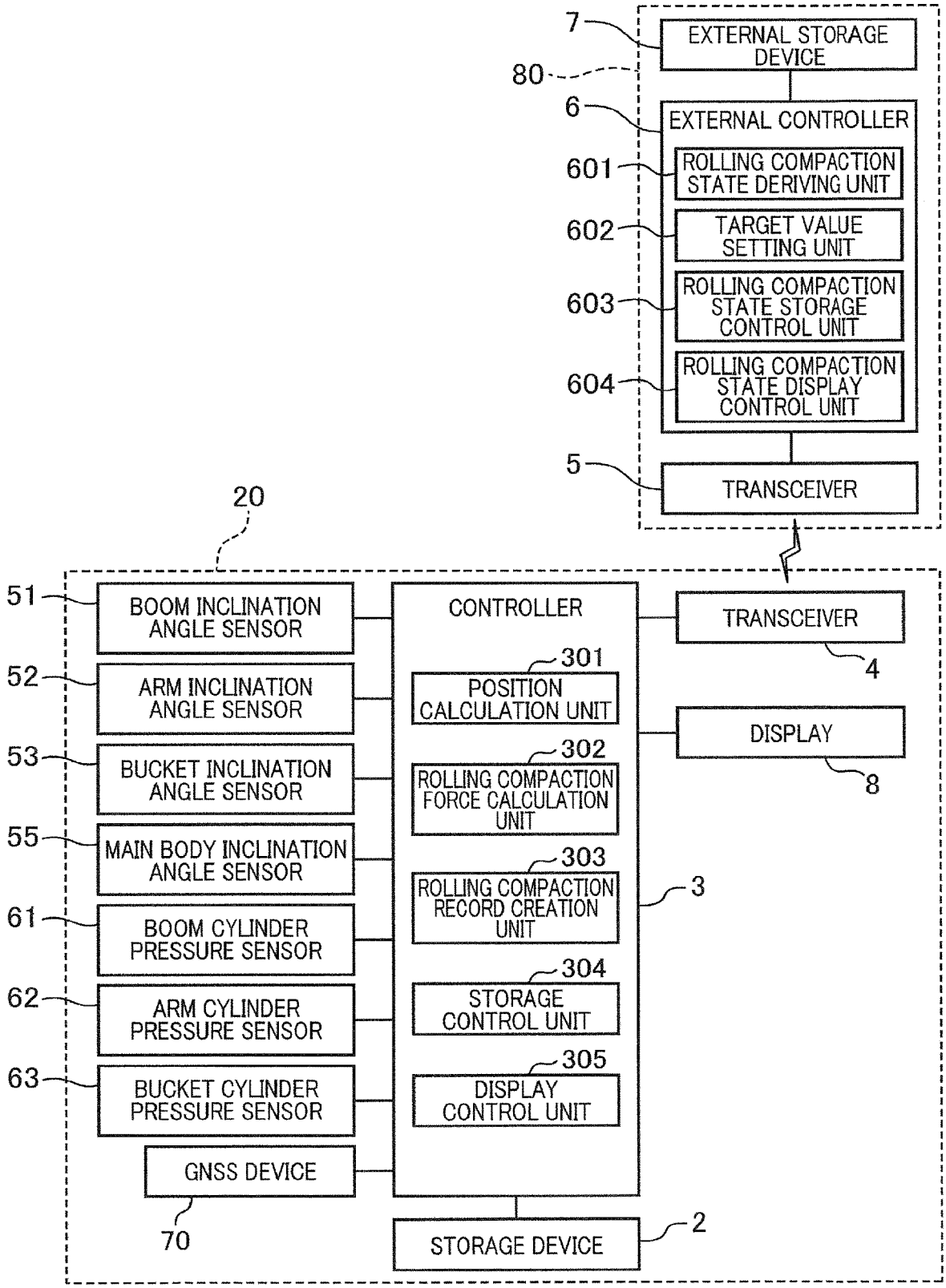
FIG. 3 is a circuit diagram of a compaction management system.

FIG. 3 is a circuit diagram of the compaction management system 1. As illustrated in FIG. 3, the compaction management system 1 includes a storage device 2, a controller 3, and a transceiver 4. The storage device 2, the controller 3, and the transceiver 4 are disposed in the work machine 20.

The storage device (dimension storage device) 2 stores dimensions of the attachment 30. The controller 3 includes a position calculation unit 301, a rolling compaction force calculation unit 302, a rolling compaction record creation unit 303, a storage control unit 304, and a display control unit 305. The position calculation unit 301 calculates, when the bucket 33 is pressed against the compaction target ground, a position of the bucket 33 using the attitude of the machine body 24 detected by the main body inclination angle sensor 55, the attitude of the attachment 30 detected by the inclination angle sensor 50, and a position and orientation of the machine body 24 detected by the individual GNSS devices 70. An example of the position of the bucket 33 is three-dimensional coordinate data indicating latitude, longitude, and height at the central position of the bottom surface of the bucket 33. The position of the bucket 33 is an example of a rolling compaction position which is a pressing position of the work device against the compaction target position.

When the bucket 33 is pressed against the compaction target ground, the rolling compaction force calculation unit 302 calculates a rolling compaction force applied to the compaction target ground 90 using the attitude of the machine body 24 detected by the main body inclination angle sensor 55, the attitude of the attachment 30 detected by the inclination angle sensor 50, the pressure detected by the pressure sensor 60, and the dimensions of the attachment 30 stored in the storage device 2.

The rolling compaction force F ($kN/m^2$) is calculated by dividing a calculation value (kN) of a pressing force, applied in a normal direction of the bottom surface of the bucket 33, by an area ($m^2$) of the bottom surface of the bucket 33.

The calculation value of the pressing force is calculated as follows. The rolling compaction force calculation unit 302 adds a moment Fct of the weight of the attachment 30 generated around the boom foot and a moment Mct calculated from cylinder thrust to calculate the calculation value of the pressing force. The moment Fct is calculated using the inclination angle of the boom 31 detected by the boom inclination angle sensor 51, the inclination angle of the arm 32 detected by the arm inclination angle sensor 52, the inclination angle of the bucket 33 detected by the bucket inclination angle sensor 53, and the inclination angle of the machine body 24 detected by the main body inclination angle sensor 55.

The moment Mct is calculated as follows. The rolling compaction force calculation unit 302 calculates the cylinder thrust of each of the boom cylinder 41, the arm cylinder 42, and the bucket cylinder 43 using the pressure on the head side and the pressure on the rod side detected by each of the boom cylinder pressure sensor 61, the arm cylinder pressure sensor 62, and the bucket cylinder pressure sensor 63. Then, the rolling compaction force calculation unit 302 calculates the moment Mct using the calculated cylinder thrust.

The rolling compaction force calculation unit 302 may sequentially calculate the above-described calculation value of the pressing force during the operation of the work machine 20. In this case, when the calculation value of the pressing force exceeds a predetermined threshold, the position calculation unit 301 and the rolling compaction force calculation unit 302 may determine that the bucket 33 is pressed against the compaction target ground 90.

The GNSS device (time detection device) 70 detects a time when the bucket 33 is pressed against the compaction target ground 90. The rolling compaction record creation unit 303 creates a rolling compaction record in which the position of the bucket 33 calculated by itself, the rolling compaction force calculated by itself, and the time detected by the GNSS device 70 are associated with each other.

The transceiver 4 includes a communication circuit capable of transmitting and receiving information to and from the outside of the work machine 20.

Further, the compaction management system 1 includes an external management device 80. The external management device 80 is disposed outside the work machine 20. The external management device 80 is a server or a server group on a cloud. The external management device 80 includes a transceiver 5, an external controller 6, and an external storage device 7. The transceiver 5 includes a communication circuit capable of externally transmitting and receiving information.

The storage control unit 304 of the controller 3 causes the storage device 2 to store the rolling compaction record created by itself. Storing the rolling compaction record in the storage device 2 enables quantitative management of the rolling compaction force applied to a compacted portion of the compaction target ground 90. Therefore, the compaction state of the compaction target ground 90 can be accurately managed.

The rolling compaction record stored in the storage device 2 includes the time when the bucket 33 is pressed against the compaction target ground 90. Therefore, the time enables easy ascertainment of work efficiency.

The compaction management system 1 includes a display (display device) 8. The display 8 is disposed in the cab 23 of the work machine 20.

The display control unit 305 causes the display 8 to display the rolling compaction record created by itself. As a result, the operator who operates the work machine 20 can ascertain the compaction state of the compaction target ground 90.

Figure 4:
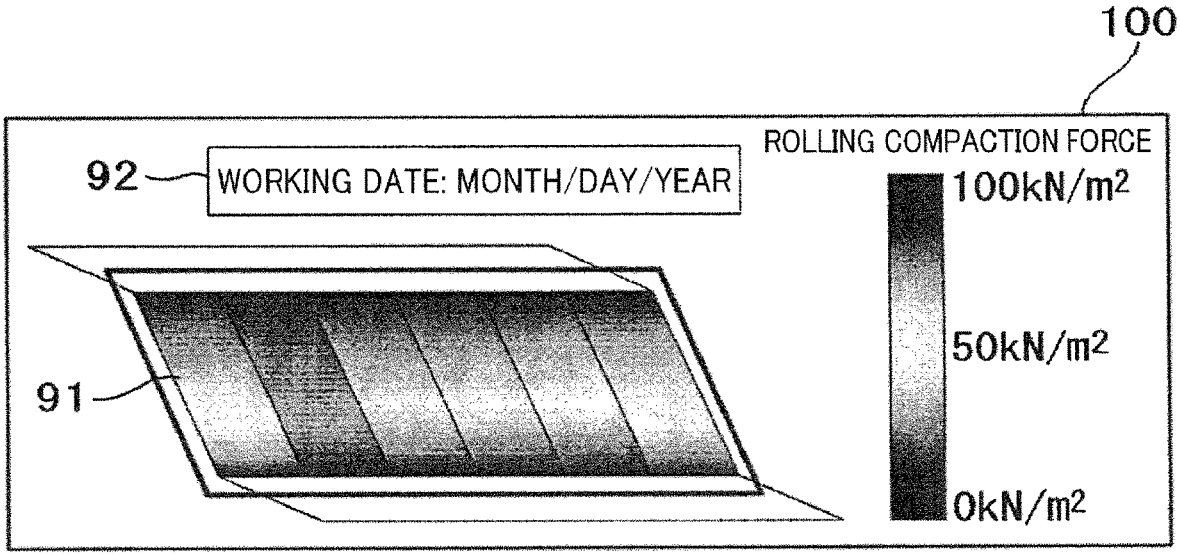
FIG. 4 is a diagram illustrating a rolling compaction record management screen displayed on a display.

FIG. 4 is a diagram illustrating a rolling compaction record management screen 100 displayed on the display 8. The rolling compaction record management screen 100 shows a ground image 91 simulating the compaction target ground 90. A surface of the ground image 91 is color-coded according to the applied rolling compaction force. Thus, the distribution of the rolling compaction force can be seen at a glance. In addition, the rolling compaction record management screen 100 shows an information image 92 including information on execution date of work and the like.

Note that the rolling compaction record management screen 100 is not limited to that illustrated in FIG. 4. For example, the rolling compaction record management screen 100 may show position data of the bucket 33 and a numerical value of the rolling compaction force applied to the position in a text format.

Returning to FIG. 3, the external storage device (target value storage device) 7 of the external management device 80 stores target values of the rolling compaction forces at a plurality of locations on the compaction target ground 90. The controller 3 causes the transceiver 4 to transmit the rolling compaction record stored in the storage device 2 to the external management device 80.

The external controller 6 includes a rolling compaction state deriving unit 601, a target value setting unit 602, a rolling compaction state storage control unit 603, and a rolling compaction state display control unit 604.

The rolling compaction state deriving unit 601 derives a rolling compaction state in a specific position of the compaction target ground 90 using the target values stored in the external storage device 7 and the rolling compaction record received from the work machine 20. Here, the rolling compaction state is a state of whether the rolling compaction force has been applied. This rolling compaction state enables a determination of whether the rolling compaction force has been applied to the specific position of the compaction target ground 90.

Alternatively, the rolling compaction state is a state of whether the applied rolling compaction force has reached the target value. This rolling compaction state enables a determination of whether the applied rolling compaction force is sufficient at the specific position of the compaction target ground 90.

Here, the target values of the rolling compaction forces stored in the external storage device 7 are different from each other depending on positions on the compaction target ground 90. For example, even when the target values are different between a peripheral portion and a central portion of the compaction target ground 90, the rolling compaction state at each position on the compaction target ground 90 can be ascertained.

The target value setting unit 602 sets target values based on a shape of the compaction target ground 90. For example, in the case where the compaction target ground 90 easily loses its shape, the target value setting unit 602 sets the target values to reflect the loss of shape in this value. As a result, the rolling compaction state can be derived based on the shape of the compaction target ground 90.

The rolling compaction state storage control unit 603 causes the external storage device (rolling compaction state storage device) 7 to store the rolling compaction state derived by itself. This enables the management of the rolling compaction state.

The rolling compaction state display control unit 604 causes the display (rolling compaction state display device) 8 to display the rolling compaction state derived by itself. Specifically, the external controller 6 causes the transceiver 5 to transmit the rolling compaction state to the work machine 20, and the controller 3 of the work machine 20 causes the display 8 to display the rolling compaction state. As a result, the operator operating the work machine 20 can ascertain the rolling compaction state.

Figure 5:
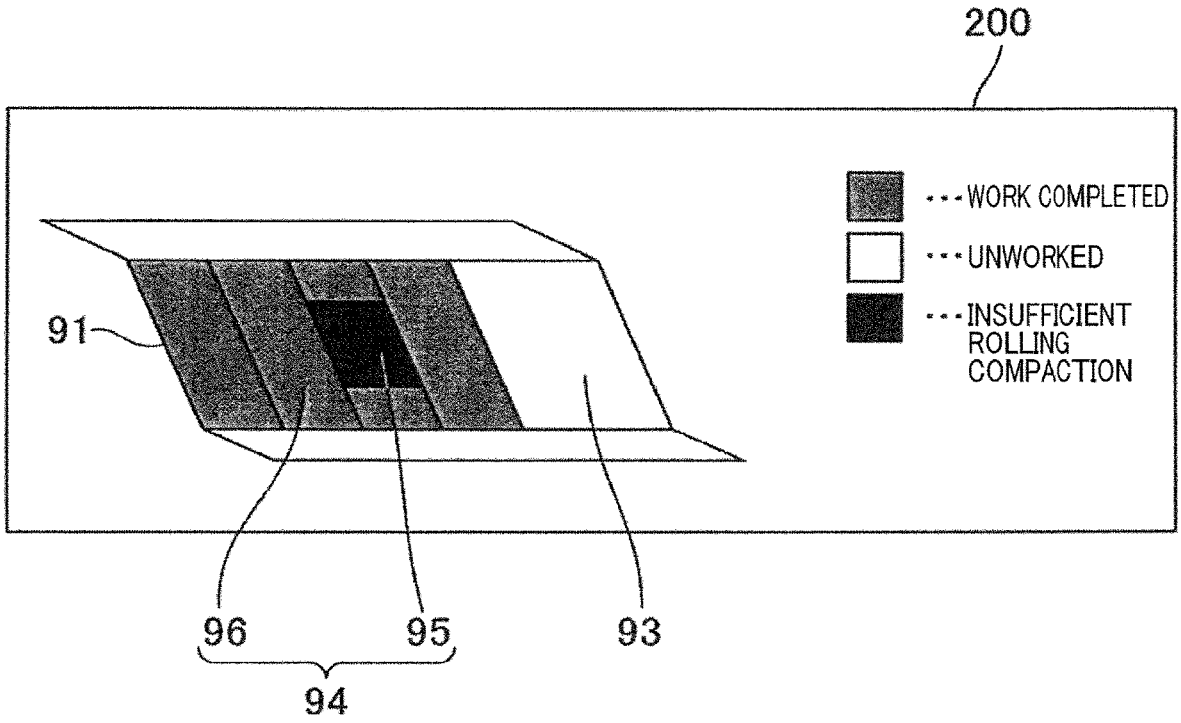
FIG. 5 is a diagram illustrating a rolling compaction state management screen displayed on the display.

FIG. 5 is a diagram illustrating a rolling compaction state management screen 200 displayed on the display 8. The rolling compaction state management screen 200 shows, similarly to the rolling compaction record management screen 100, a ground image 91 simulating the compaction target ground 90. The surface of the ground image 91 is color-coded according to the state of whether the rolling compaction force has been applied. Specifically, an unworked region 93 to which the rolling compaction force has not been applied and a worked region 94 to which the rolling compaction force has been applied are color-coded. In addition, the worked region 94 is color-coded according to the state of whether the rolling compaction force has reached the target value. Specifically, an insufficient region 95 where the rolling compaction force has not reached the target value and an achievement region 96 where the rolling compaction force has reached the target value and the work has been completed are color-coded. As a result, the operator operating the work machine 20 can ascertain the rolling compaction state.

Modified Examples

Note that the present invention is not limited to the configuration in which the controller 3 of the work machine 20 calculates the position of the bucket 33 and the rolling compaction force applied to the compaction target ground 90 when the bucket 33 is pressed against the compaction target ground 90, and the external controller 6 of the external management device 80 may calculate them. Specifically, the controller 3 causes the transceiver 4 to transmit the attitude of the machine body 24 detected by the main body inclination angle sensor 55, the attitude of the attachment 30 detected by the inclination angle sensor 50, and the position and orientation of the machine body 24 detected by the GNSS devices 70 to the external management device 80, and the external controller 6 calculates the position of the bucket 33 using them. In addition, the controller 3 causes the transceiver 4 to transmit the attitude of the machine body 24 detected by the main body inclination angle sensor 55, the attitude of the attachment 30 detected by the inclination angle sensor 50, the pressure detected by the pressure sensor 60, and the dimensions of the attachment 30 stored in the storage device 2 to the external management device 80, and the external controller 6 calculates the rolling compaction force applied to the compaction target ground 90 using them.

In addition, the present invention is not limited to the configuration in which the controller 3 of the work machine 20 creates the rolling compaction record, and the external controller 6 of the external management device 80 may create the rolling compaction record. Specifically, the controller 3 causes the transceiver 4 to transmit the calculated position of the bucket 33, the time when the bucket 33 is pressed against the compaction target ground 90, and the calculated rolling compaction force to the external management device 80, and the external controller 6 creates the rolling compaction record in which they are associated with each other. In this case, the external controller 6 may cause the external storage device 7 to store the created rolling compaction record. As a result, the rolling compaction record can be managed independently of the work machine 20. Therefore, the compaction state of the compaction target ground 90 can be managed externally and centrally.

In addition, although the display 8 displays each of the rolling compaction record management screen 100 and the rolling compaction state management screen 200 in this configuration, a display device may display the rolling compaction record management screen 100 and a different display device (rolling compaction state display device) may display the rolling compaction state management screen 200. In addition, although the display 8 is disposed in the work machine 20 in this configuration, it may be disposed in the external management device 80.

Effects

As described above, the compaction management system 1 according to the present embodiment causes the creation of the rolling compaction record in which the position of the bucket 33 pressed against the compaction target ground 90 is associated with the rolling compaction force applied to the compaction target ground 90. Then, the rolling compaction record is stored in the storage device 2. This enables quantitative management of the rolling compaction force applied to the compacted portion of the compaction target ground 90. Therefore, the compaction state of the compaction target ground can be accurately managed.

In addition, the rolling compaction record stored in the storage device 2 includes the time when the bucket 33 is pressed against the compaction target ground 90. Therefore, the time enables easy ascertainment of work efficiency.

Further, when the rolling compaction record is stored in the external storage device 7, the rolling compaction record can be managed independently of the work machine 20. Therefore, the compaction state of the compaction target ground 90 can be managed externally and centrally.

In addition, the display 8 displays the rolling compaction record. This enables ascertainment of the compaction state of the compaction target ground 90.

In addition, a rolling compaction state at a specific position of the compaction target ground 90 is derived using the target values of the rolling compaction force and the rolling compaction record. This rolling compaction state enables the determination of whether the rolling compaction force has been applied and the rolling compaction force is sufficient at the specific position of the compaction target ground 90.

In addition, the rolling compaction state is the state of whether the rolling compaction force has been applied. This rolling compaction state enables the determination of whether the rolling compaction force has been applied to the specific position of the compaction target ground 90.

Further, the rolling compaction state is a state of whether the rolling compaction force has reached the target value. This rolling compaction state enables the determination of whether the applied rolling compaction force is sufficient at the specific position of the compaction target ground 90.

In addition, the target value of the rolling compaction force varies with a position in the compaction target ground 90. For example, even when the target values are different between the peripheral portion and the central portion of the compaction target ground 90, the rolling compaction state at each portion of the compaction target ground 90 can be ascertained.

In addition, the target value is set based on the shape of the compaction target ground 90. For example, in the case where the compaction target ground 90 easily loses its shape, the target value is set to reflect the loss of shape. As a result, the rolling compaction state can be derived based on the shape of the compaction target ground 90.

Further, the derived rolling compaction state is stored in the external storage device 7. This enables the management of the rolling compaction state.

Further, the derived rolling compaction state is displayed on the display 8. This enables the ascertainment of the rolling compaction state.

Although the embodiment of the present invention has been described above, it is merely an example. The present invention is not particularly limited to the embodiment, and the specific configuration and the like can be modified in design as appropriate. In addition, the actions and effects described in the embodiment of the present invention are merely the most suitable actions and effects resulting from the present invention, and the actions and effects of the present invention are not limited to those described in the embodiment of the present invention.

SUMMARY OF THE PRESENT EMBODIMENT

The technical features of the present embodiment are summarized as follows.

A compaction management system according to an aspect of the present invention includes: a work machine including; a machine body, a work device attached to the machine body rotatably and vertically, a rotary device capable of hydraulically rotating the work device, a machine body attitude detection device that detects an attitude of the machine body, a work device attitude detection device that detects an attitude of the work device, a position detection device that detects a position of the machine body, an orientation detection device that detects an orientation of the machine body, a pressure detection device that detects a pressure of the rotary device, and a dimension storage device that stores dimensions of the work device; a position calculation unit that, when the work device is pressed against a compaction target ground, calculates a rolling compaction position which is a pressing position of the work device against the compaction target ground using the attitude of the machine body detected by the machine body attitude detection device, the attitude of the work device detected by the work device attitude detection device, the position of the machine body detected by the position detection device, and the orientation of the machine body detected by the orientation detection device; a rolling compaction force calculation unit that, when the work device is pressed against the compaction target ground, calculates a rolling compaction force applied to the compaction target ground using the attitude of the machine body detected by the machine body attitude detection device, the attitude of the work device detected by the work device attitude detection device, the pressure detected by the pressure detection device, and the dimensions of the work device stored in the dimension storage device; a rolling compaction record creation unit that creates a rolling compaction record in which the rolling compaction position is associated with the rolling compaction force calculated by the rolling compaction force calculation unit; a storage device; and a storage control unit that causes the storage device to store the rolling compaction record created by the rolling compaction record creation unit.

This configuration causes the creation of the rolling compaction record in which the rolling compaction position calculated when the work device is pressed against the compaction target ground is associated with the rolling compaction force applied to the compaction target ground. Then, the rolling compaction record is stored in the storage device. This enables quantitative management of the rolling compaction force applied to the compacted portion of the compaction target ground. Therefore, the compaction state of the compaction target ground can be accurately managed.

In the compaction management system, preferably, the work machine further includes a time detection device that detects a time when the work device is pressed against the compaction target ground, and the rolling compaction record creation unit creates the rolling compaction record in which the rolling compaction position, the rolling compaction force calculated by the rolling compaction force calculation unit, and the time detected by the time detection device are associated with each other.

According to this configuration, the rolling compaction record stored in the storage device includes the time when the work device is pressed against the compaction target ground. Therefore, the time enables easy ascertainment of work efficiency.

In the compaction management system, the storage device is preferably disposed outside the work machine.

According to this configuration, the rolling compaction record is provided outside the work machine, and thus the rolling compaction record can be managed independently of the work machine. Therefore, the compaction state of the compaction target ground can be managed externally and centrally.

The compaction management system preferably further includes a display device, and a display control unit that causes the display device to display the rolling compaction record created by the rolling compaction record creation unit.

According to this configuration, the rolling compaction record is displayed on the display device. This enables the ascertainment of the compaction state of the compaction target ground.

The compaction management system preferably further includes a target value storage device that stores target values of a rolling compaction force at a plurality of locations of the compaction target ground, and a rolling compaction state deriving unit that derives a rolling compaction state at a specific position of the compaction target ground using the target values stored in the target value storage device and the rolling compaction record stored in the storage device.

According to this configuration, the rolling compaction state at the specific position of the compaction target ground is derived using the target values of the rolling compaction force and the rolling compaction record. This rolling compaction state enables the determination of whether the rolling compaction force has been applied and the rolling compaction force is sufficient at the specific position on the compaction target ground.

In the compaction management system, the rolling compaction state is preferably a state of whether the rolling compaction force has been applied.

According to this configuration, the rolling compaction state is the state of whether the rolling compaction force has been applied. This rolling compaction state enables the determination of whether the rolling compaction force has been applied to the specific position of the compaction target ground.

In the compaction management system, the rolling compaction state is preferably a state of whether the rolling compaction force has reached the target value.

According to this configuration, the rolling compaction state is the state of whether the rolling compaction force has reached the target value. This rolling compaction state enables the determination of whether the applied rolling compaction force is sufficient at the specific position of the compaction target ground.

In the compaction management system, the target value preferably varies with a position in the compaction target ground.

According to this configuration, the target value of the rolling compaction force varies with a position in the compaction target ground. For example, even when the target values are different between the peripheral portion and the central portion of the compaction target ground, the rolling compaction state at each position in the compaction target ground can be ascertained.

The compaction management system preferably further includes a target value setting unit that sets the target values based on the shape of the compaction target ground.

According to this configuration, the target value can be set base on the shape of the compaction target ground. For example, in the case where the compaction target ground easily loses its shape, the target value is set to reflect the loss of shape. This enables the deriving of the rolling compaction state based on the shape of the compaction target ground.

The compaction management system preferably further includes a rolling compaction state storage device capable of storing the rolling compaction state, and a rolling compaction state storage control unit that causes the rolling compaction state storage device to store the rolling compaction state derived by the rolling compaction state deriving unit.

This configuration causes the rolling compaction state storage device to store the derived rolling compaction state. This enables the management of the rolling compaction state.

The compaction management system preferably further includes a rolling compaction state display device capable of displaying the rolling compaction state, and a rolling compaction state display control unit that causes the rolling compaction state display device to display the rolling compaction state derived by the rolling compaction state deriving unit.

This configuration causes the rolling compaction state display device to display the derived rolling compaction state. This enables the ascertainment of the rolling compaction state.

The invention claimed is:

1. A compaction management system, comprising:

a work machine including;

a machine body, a work device attached to the machine body rotatably and vertically, a rotary device capable of hydraulically rotating the work device, a machine body attitude detection device that detects an attitude of the machine body, a work device attitude detection device that detects an attitude of the work device, a position detection device that detects a position of the machine body, an orientation detection device that detects an orientation of the machine body, a pressure detection device that detects a pressure of the rotary device, and a dimension storage device that stores dimensions of the work device;

a position calculation unit that, when the work device is pressed against a compaction target ground, calculates a rolling compaction position which is a pressing position of the work device against the compaction target ground using the attitude of the machine body detected by the machine body attitude detection device, the attitude of the work device detected by the work device attitude detection device, the position of the machine body detected by the position detection device, and the orientation of the machine body detected by the orientation detection device;

a rolling compaction force calculation unit that, when the work device is pressed against the compaction target ground, calculates a rolling compaction force applied to the compaction target ground using the attitude of the machine body detected by the machine body attitude detection device, the attitude of the work device detected by the work device attitude detection device, the pressure detected by the pressure detection device, and the dimensions of the work device stored in the dimension storage device;

a rolling compaction record creation unit that creates a rolling compaction record in which the rolling compaction position is associated with the rolling compaction force calculated by the rolling compaction force calculation unit;

a storage device; and a storage control unit that causes the storage device to store the rolling compaction record created by the rolling compaction record creation unit.

2. The compaction management system according to claim 1, wherein the work machine further includes a time detection device that detects a time when the work device is pressed against the compaction target ground, and the rolling compaction record creation unit creates the rolling compaction record in which the rolling compaction position, the rolling compaction force calculated by the rolling compaction force calculation unit, and the time detected by the time detection device are associated with each other.

3. The compaction management system according to claim 1, wherein the storage device is disposed outside the work machine.

4. The compaction management system according to claim 1, further comprising:

a display device; and a display control unit that causes the display device to display the rolling compaction record created by the rolling compaction record creation unit.

5. The compaction management system according to claim 1, further comprising:

a target value storage device that stores target values of a rolling compaction force at a plurality of locations of the compaction target ground; and a rolling compaction state deriving unit that derives a rolling compaction state at a specific position of the compaction target ground using the target values stored in the target value storage device and the rolling compaction record stored in the storage device.

6. The compaction management system according to claim 5, wherein the rolling compaction state is a state of whether the rolling compaction force has been applied.

7. The compaction management system according to claim 5, wherein the rolling compaction state is a state of whether the rolling compaction force has reached the target value.

8. The compaction management system according to claim 5, wherein the target value varies with a position on the compaction target ground.

9. The compaction management system according to claim 5, further comprising a target value setting unit that sets the target values based on a shape of the compaction target ground.

10. The compaction management system according to claim 5, further comprising:

a rolling compaction state storage device capable of storing the rolling compaction state; and a rolling compaction state storage control unit that causes the rolling compaction state storage device to store the rolling compaction state derived by the rolling compaction state deriving unit.

11. The compaction management system according to claim 5, further comprising:

a rolling compaction state display device capable of displaying the rolling compaction state; and a rolling compaction state display control unit that causes the rolling compaction state display device to display the rolling compaction state derived by the rolling compaction state deriving unit.

* * * * *